US006986456B2

(12) United States Patent
Jone

(10) Patent No.: US 6,986,456 B2
(45) Date of Patent: Jan. 17, 2006

(54) PACKING BOX

(75) Inventor: Main-Dar Jone, Danshuei (TW)

(73) Assignee: Tatung Co., Ltd., Taipei (TW)

( * ) Notice: Subject to any disclaimer, the term of this patent is extended or adjusted under 35 U.S.C. 154(b) by 46 days.

(21) Appl. No.: 10/871,815

(22) Filed: Jun. 21, 2004

(65) Prior Publication Data

US 2005/0109825 A1 May 26, 2005

(30) Foreign Application Priority Data

Nov. 20, 2003 (TW) ..... 92220548 U

(51) Int. Cl.
*B65D 5/42* (2006.01)
*B65D 5/478* (2006.01)

(52) U.S. Cl. ..... 229/117.11; 229/117.23; 229/117.24; 229/122.27; 229/125.22

(58) Field of Classification Search ..... 229/117.11, 229/117.23, 117.24, 122.27, 122.3, 125.19, 229/125.21, 125.22
See application file for complete search history.

(56) References Cited

U.S. PATENT DOCUMENTS 304,525 A * 9/1884 Hohenstein ..... 229/125.19
577,416 A * 2/1897 Brown ..... 229/117.11
977,770 A * 12/1910 Wolf ..... 229/122.24
1,147,745 A * 7/1915 Neinken et al. ..... 229/125.22
2,281,836 A * 5/1942 Engel ..... 229/122.27
2,741,420 A * 4/1956 Bodard ..... 229/117.11
2,771,237 A * 11/1956 Philipson ..... 229/125.22
3,301,453 A * 1/1967 Stewart ..... 229/117.11
3,516,595 A * 6/1970 Bailey ..... 229/117.11
3,563,433 A * 2/1971 Yoshiura et al. ..... 229/117.11
4,643,380 A * 2/1987 Copeland ..... 229/122.3
5,570,834 A * 11/1996 Larson et al. ..... 229/117.11
5,713,510 A * 2/1998 Walton ..... 229/117.11
6,601,757 B2 * 8/2003 Bowman ..... 229/125.22
6,827,217 B2 * 12/2004 Matsuguchi et al. ... 229/117.25

* cited by examiner

*Primary Examiner*—Gary E. Elkins
(74) *Attorney, Agent, or Firm*—Bacon & Thomas, PLLC

(57) ABSTRACT

The packing box includes a bottom containment box comprising a containment space and a bottom base, the bottom base comprising two first length-wise flaps and two first width-wise flaps; a loop clamped between the length-wise flap and the width-wise flap of the bottom base and forming two lifting loops; and a cover box for covering the bottom containment box, the cover box comprising a containment room and a top cover, the top cover comprising two second length-wise flaps and two second width-wise flaps, each second width-wise flap having two slots.

5 Claims, 3 Drawing Sheets

PACKING BOX

BACKGROUND OF THE INVENTION

1. Field of the Invention

The present invention relates to an improved structure for a packing box used for packing different objects.

2. Description of the Related Art

Packing boxes are common for the quick moving and transportation of materials; they can be used for packing all manner of objects, such as house keeping items, furniture, books, foods, toys, and etc. However, the prior art packing box has many pieces, and requires manual assembly. This can lead to higher packing costs.

Therefore, it is desirable to provide a packing box to mitigate and/or obviate the aforementioned problems.

SUMMARY OF THE INVENTION

A main objective of the present invention is to provide a packing box that simplifies the packing process, reduces packing-related costs, and has a reduced number of pieces.

In order to Achieve the above-mentioned objective, the packing box of the present invention comprises a bottom containment box comprising a containment space and a bottom base, the bottom base comprising two first length-wise flaps and two first width-wise flaps; a loop clamped between the two first length-wise flaps and the two first width-wise flaps of the bottom base and leaving two lifting loops outside; and a cover box for covering above the bottom containment box, the cover box comprising a containment room and a top cover, the top cover comprising two second length-wise flaps and two second width-wise flaps, each second width-wise flap having two slots.

In the present invention, the two slots of each corresponding second width-wise flap are used for engaging with one of the two lifting loops, and the two slots of each corresponding second width-wise flap are formed by reversely folding the corresponding second width-wise flap along a folding line located in the middle of the corresponding second width-wise flap and then by carving the folding line with a knife. Actually, since one end of the width-wise flap is reversely folded, when the lifting loops are placed in the slots, the slots are strong enough to prevent lifting damage. The loop is made of flexible material selected from a group of PP, PE, nylon, cotton and any other common material. Furthermore, the two first length-wise flaps and the two second length-wise flaps are sealed with tape.

Other objects, advantages, and novel features of the invention will become more apparent from the following detailed description when taken in conjunction with the accompanying drawings.

DETAILED DESCRIPTION OF THE PREFERRED EMBODIMENT

Figure 1A:
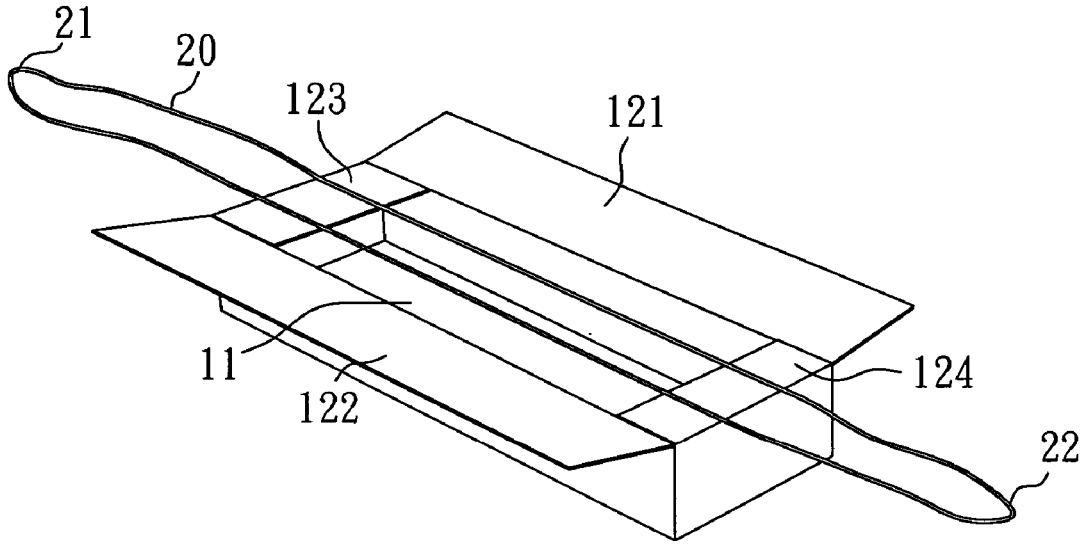
FIGS. 1A to 1C show an assembly flowchart of a bottom case and loop according to the present invention.
Figure 1B:
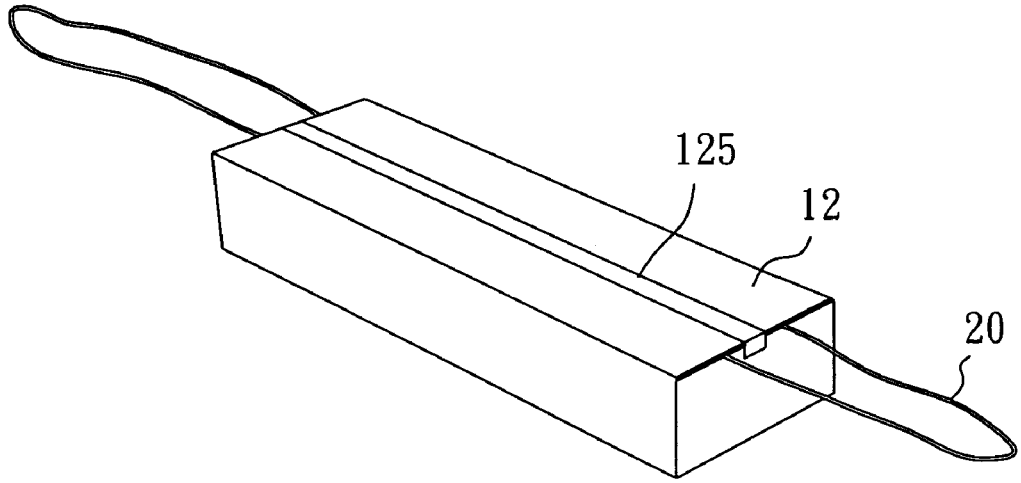
Figure 1C:
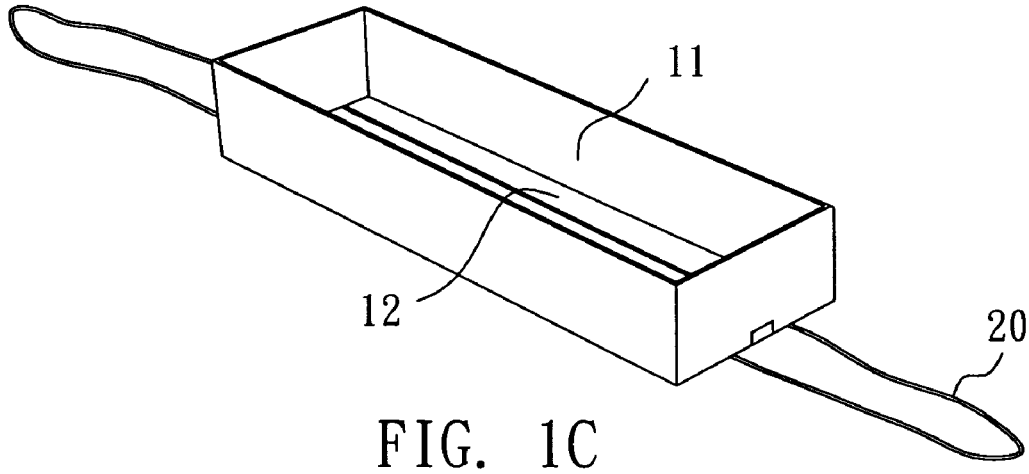
Figure 2:
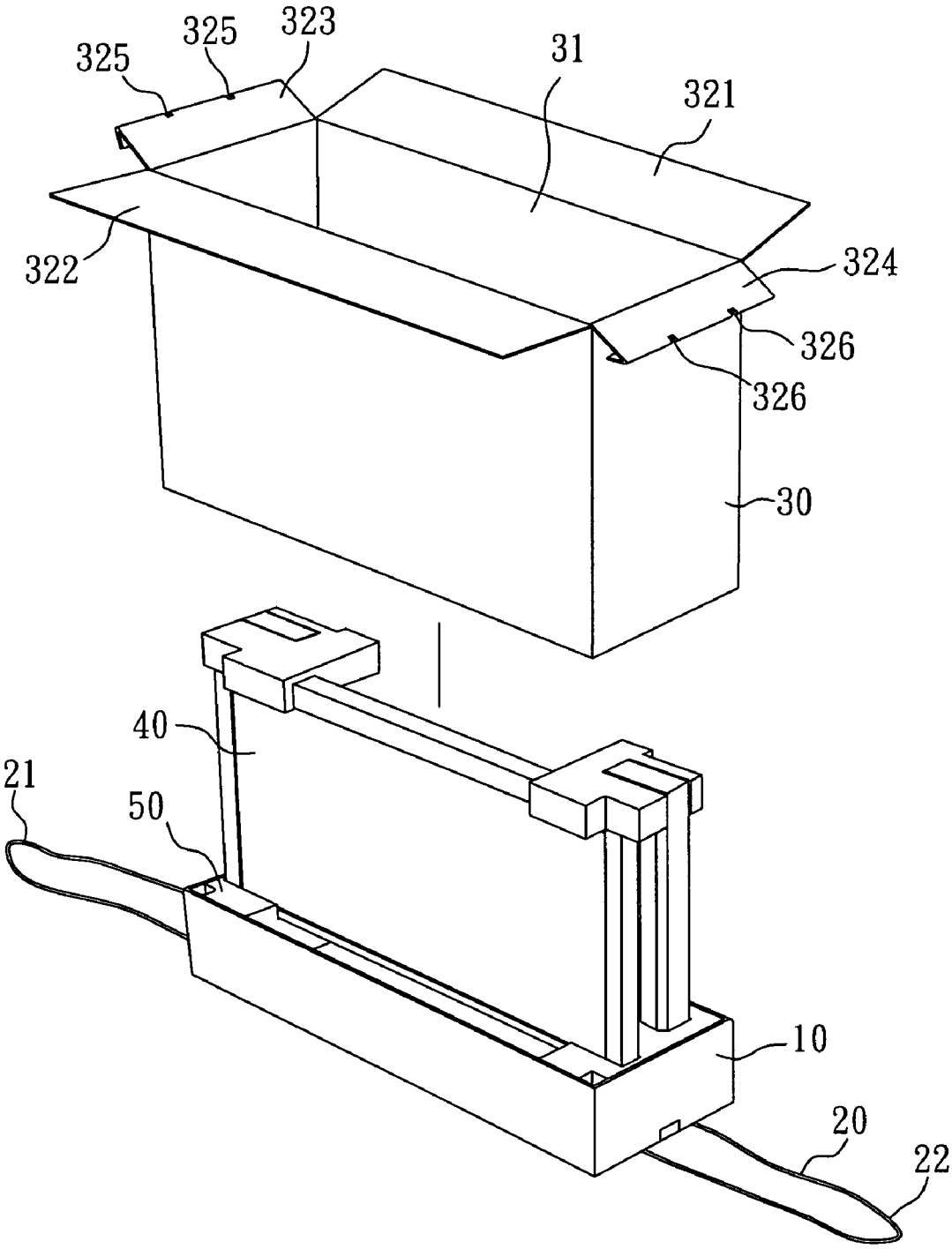
FIG. 2 is a schematic drawing for an assembly procedure according to the present invention.
Figure 4:
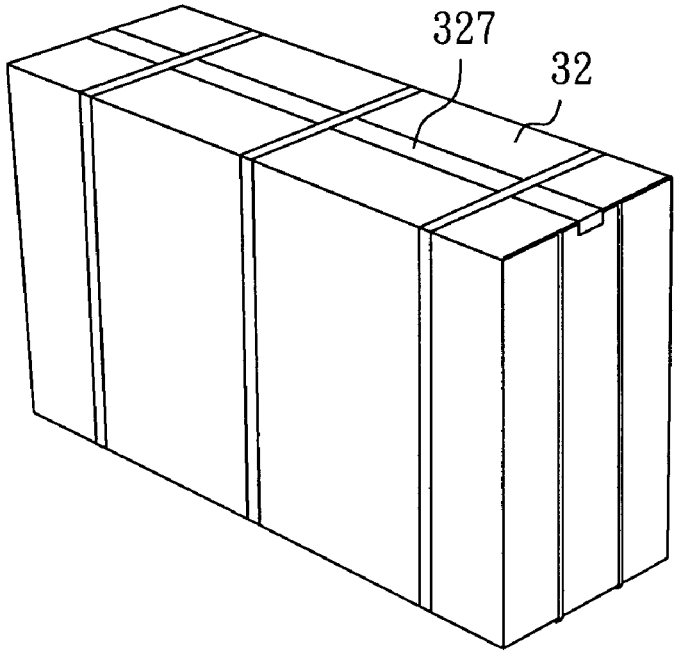
FIG. 4 shows a completed assembly of the packing box according to the present invention.

A packing box of the present invention comprises a bottom containment box 10, a loop 20 and a cover box 30, as shown in FIG. 2. Please refer to FIG. 1A to 1C. The bottom containment box 10 has a containment space 11 and a bottom base 12. The bottom base 11 comprises two first length-wise flaps 121, 122 and two first width-wise flaps 123, 124. The loop 20 leaves two lifting loops 21 outside, 22 at its two ends, and may be made from PP, PE, nylon or cotton. In this embodiment, the loop 20 is made from PP. When the bottom containment box 10 and the loop 20 are combined, the loop 20 is placed on the two first width-wise flaps 123, 124, as shown in FIG. 1A. Next, the two length-wise flaps 121, 122 cover the loop 20, and then tape 125 is used to seal the two length-wise flaps 121, 122 to form the bottom base 122. Meanwhile, the loop 20 is clamped between the length-wise flaps 121, 122 and the width-wise flaps 123, 124 of the bottom base, with the two lifting loops 21, 22 evenly extending from both sides of the containment space 11 of the bottom containment box 10, as shown in FIG. 1B. The bottom containment box 10 is turned up side down, so that the bottom base 12 faces down and the containment space 11 is exposed, as shown in FIG 1C. Please refer to FIG. 2. FIG. 2 is a schematic drawing for an assembly procedure according to the present invention. The cover box 30 comprises a containment room 31 and a top cover 32 (as shown in FIG. 4). The top cover 32 comprises two second length-wise flaps 321, 322, and two second width-wise flaps 323, 324. Two slots 325, 326 on each second width-wise flap are formed by reversely folding one end of the width-wise flap, and then cutting the folded portion with a knife.

Figure 3:
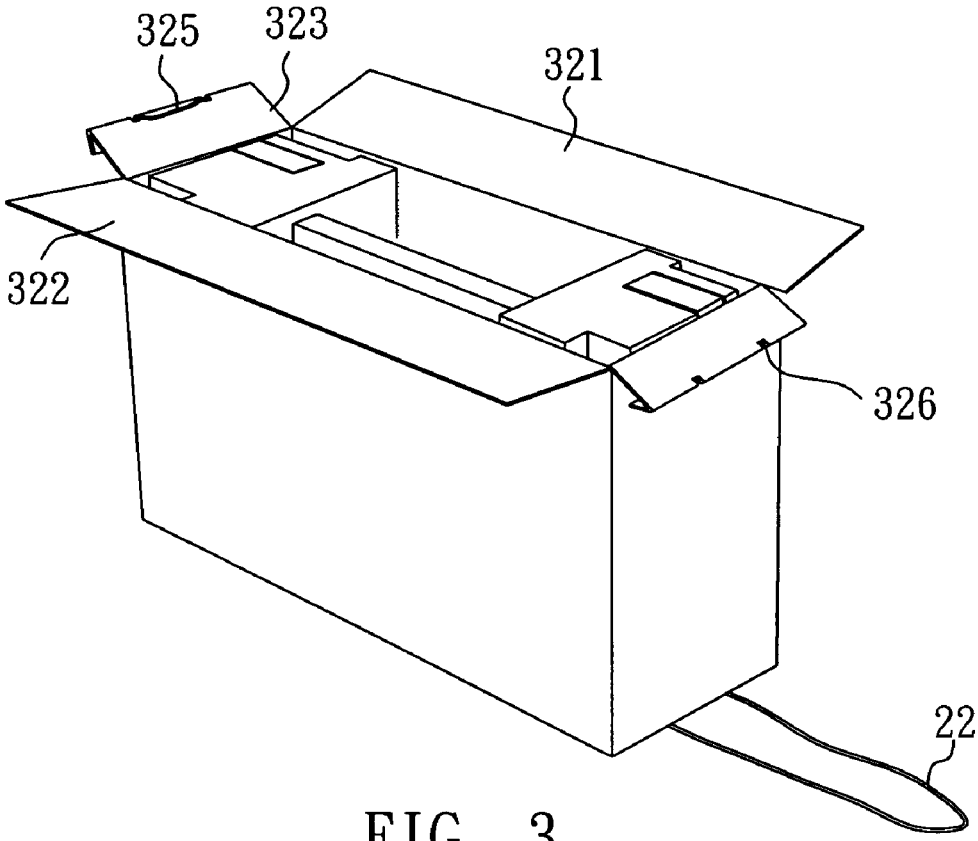
FIG. 3 is a schematic drawing for a further assembly procedure according to the present invention.

Before using the packing box of the present invention to pack an object 40, packing material 50 can be placed in the containment space 11 of the bottom containment box 10 to avoid damage to the object 40. Then, packing material 50 is placed on the object 40 and the cover box 30 is used to cover the object 40 and the bottom containment box 10, as shown in FIG. 3. Finally, the two lifting loops 21, 22 are respectively hooked on the two slots 325, 326, the two second width-wise flaps 323, 324 are folded toward the containment room 31, and the two second length-wise flaps 321, 322 are taped with tape 327 to finish the entire packing process. If necessary, additional tape or loops can be added in a direction perpendicular to the direction of the tape 327 to increase integrity of the packing.

The present invention provides a simple packing box that has few pieces and a low cost. Furthermore, the present invention can also reduce human effort and cost due to its simple structure.

Although the present invention has been explained in relation to its preferred embodiment, it is to be understood that many other possible modifications and variations can be made without departing from the spirit and scope of the invention as hereinafter claimed.

What is claimed is:

1. A packing box comprising:

a bottom containment box comprising a containment space and a bottom base, the bottom base comprising two first length-wise flaps and two first width-wise flaps;

a loop clamped between the two first length-wise flaps and the two first width-wise flaps of the bottom base and leaving two lifting loops outside; and a cover box for covering above the bottom containment box, the cover box comprising a containment room and a top cover, the top cover comprising two second length-wise flaps and two second width-wise flaps, each second width-wise flap having two slots.

2. The packing box as claimed in claim 1, wherein the two slots of each corresponding second width-wise flap are used for engaging with one of the two lifting loops of the loop.

3. The packing box as claimed in claim 1, wherein the two slots of each corresponding second width-wise flap are formed by reversely folding the corresponding second width-wise flap along a folding line located in the middle of the corresponding second width-wise flap and then by carving the folding line with a knife.

4. The packing box as claimed in claim 1, wherein the loop is made of flexible material selected from a group of PP, PE, nylon and cotton.

5. The packing box as claimed in claim 1, wherein the two first length-wise flaps and the two second length-wise flaps are sealed with tape.

* * * * *